US005830373A

United States Patent [19]

Ohtake et al.

[11] Patent Number: 5,830,373

[45] Date of Patent: Nov. 3, 1998

[54] COLOR CATHODE RAY TUBE AND METHOD OF MANUFACTURING SHADOW MASK

[75] Inventors: Yasuhisa Ohtake; Seiji Sago; Mitsuaki Yamazaki, all of Fukaya; Sachiko Muramatsu, Tatebayashi, all of Japan

[73] Assignee: Kabushiki Kaisha Toshiba, Kawasaki, Japan

[21] Appl. No.: 736,237

[22] Filed: Oct. 23, 1996

Related U.S. Application Data

[63] Continuation of Ser. No. 451,814, May 26, 1995, Pat. No. 5,592,044.

[30] Foreign Application Priority Data

May 27, 1994 [JP] Japan ..... 6-113232

[51] Int. Cl.[6] ..... B44C 1/22

[52] U.S. Cl. ..... 216/12; 216/41; 216/56

[58] Field of Search ..... 216/12, 25, 39, 216/41, 56; 313/402, 403

[56] References Cited

U.S. PATENT DOCUMENTS

| | | | |
|---|---|---|---|
| 3,179,543 | 4/1965 | Marcelis | 216/56 |
| 3,787,939 | 1/1974 | Tomita et al. . | |
| 3,929,532 | 12/1975 | Kuzminski | 216/12 |
| 4,168,450 | 9/1979 | Yamauchi et al. . | |
| 4,771,213 | 9/1988 | Higashinakagawa et al. | 216/12 X |

FOREIGN PATENT DOCUMENTS

| | | |
|---|---|---|
| 487 106 | 5/1992 | European Pat. Off. . |
| 2 166 107 | 8/1973 | France . |
| 47-7670 | 3/1972 | Japan . |
| 55-2697 | 1/1980 | Japan . |
| 59-16249 | 1/1984 | Japan . |
| 2 020 892 | 11/1979 | United Kingdom . |

*Primary Examiner*—William Powell
*Attorney, Agent, or Firm*—Cushman Darby & Cushman IP Group of Pillsbury Madison & Sutro LLP

[57] ABSTRACT

A color cathode ray tube has a face panel, a phosphor screen formed on an inner surface of the face panel, an electron gun for emitting electron beams toward the phosphor screen, and a shadow mask arranged between the electron gun and the face panel to oppose the phosphor screen. The shadow mask has a large number of electron beam apertures through which the electron beams pass. Each of the electron beam apertures has a small opening open to a first surface of the shadow mask and a large opening open to a second surface of the shadow mask and communicating with the small opening. The large opening has a center axis and a diameter larger than that of the small opening. A wall surface of the shadow mask which defines the large opening of each of the electron beam apertures located at a peripheral portion of the shadow mask includes a bulged portion. The bulged portion is located on the opposite side of a mask center with respect to the center axis of the large opening, and is bulged outward in the radial direction.

7 Claims, 6 Drawing Sheets

COLOR CATHODE RAY TUBE AND METHOD OF MANUFACTURING SHADOW MASK

This is a continuation of application Ser. No. 08/451,814 filed May 26, 1995, now issued as U.S. Pat. No. 5,592,044.

BACKGROUND OF THE INVENTION

1. Field of the Invention

The present invention relates to a color cathode ray tube ("CRT"), and specifically to an improved shadow mask used in the color cathode ray tube and a method of manufacturing the same.

2. Description of the Related Art

A convention shadow mask type color cathode ray tube comprises a number of elements: a glass envelope having a face panel, a funnel and a neck; a phosphor screen on which a plurality of phosphor dots or stripes are regularly arranged, which is formed on an inner surface of the face panel; and an electron gun disposed in the neck portion of the envelope to emit plural electron beams to the phosphor screen. A shadow mask having a large number of regularly arranged electron beam apertures is disposed near the phosphor screen and between the electron gun and the phosphor screen in the envelope.

The shadow mask, based on the principle of parallax, is a significant component which allows electron beams emitted from the electron gun to pass through the mask and land on their geometrically corresponding phosphor dots or stripes. The shadow mask made is often called a color selection electrode.

Each electron beam approaching the peripheral portion of the shadow mask has an incident angle relative to a tube axis of the cathode ray tube. Each electron beam aperture, therefore, has a specific shape that allows the electron beam to pass easily through. Each electron beam aperture of the shadow mask has a larger sectional area on the phosphor screen side of the shadow mask, as compared with that on the electron gun side. Usually, the aperture opening which is on the phosphor screen side is called a large opening and the aperture opening on the electron gun side is called a small opening.

The shadow masks are generally distinguished between those having circular electron beam apertures and those having rectangular ones. The former are usually used in display tubes that display characters and figures while the latter are used in television tubes for home application.

Recently, the display tubes are increasingly used as display units in personal and office computers or in various kinds of terminal equipment. An image with enhanced resolution, which reflects less external light and has less distortion, is more desirable and more enjoyable for human use. In order to meet these demands, the color cathode ray tube having a flatter face panel has been provided.

To conform to a flatter face panel, the shadow mask must also be flattened and have a larger radius of curvature. In the flattened shadow mask, however, the incident angle of the electron beam which enters into its corresponding electron beam aperture increases relative to the normal of the mask, as compared with that in the conventional shadow mask having a small radius of curvature. The electron beam incident angle increases more dramatically at the peripheral portion of the mask than at the center portion. A problem experienced in the conventional design is that part of the electron beam incident on the peripheral portion of the shadow mask collides against the aperture edge or aperture wall. The result of this collision is that the shape of the electron beam spot formed on the phosphor screen is distorted or so-called beam omissions are caused, thereby degrading the luminance or the uniformity of color purity. In addition, the contrast is also degraded because unintended phosphor dots are made luminous by electron beams reflected by the aperture edges and walls.

The problem of beam spot distortion is more likely as the pitch of the electron beam apertures in the shadow mask becomes smaller and the shadow mask is made thicker. In addition, the distortion is more remarkable as the angle of incidence of the electron beam relative to the normal of the mask becomes larger, as illustrated by the flatter shadow mask with a larger radius of curvature. When these conditions exist, the quality of the color cathode ray tube is degraded.

Furthermore, with an increased curvature radius of the shadow mask, the tension strength of the mask is weakened, as compared to that of the conventional shadow mask with a small curvature radius. The shadow mask, therefore, is more easily deformed by jostling or movement during manufacturing, transporting and incorporating the CRT into a television set or display unit. The deformed part of the shadow mask cannot have a predetermined distance relative to the phosphor screen. Color shift more readily exists and the quality and reliability of the color cathode ray tube cannot be guaranteed. With excessively deformation, the CRT exhibits a complete partial color shift and must be regarded as defective.

As a solution for preventing beam spot distortion or beam omissions, it has been proposed to increase the dimension of the large opening of the electron beam aperture on the phosphor screen side of the shadow mask. To accomplish this, however, the large opening of the aperture must be etched even larger as it is formed in the shadow mask. This decreases the mechanical strength of the shadow mask, thereby reducing its tension strength and causing the mask to be more easily deformed after it is pressformed.

In the shadow mask in which the electron beam apertures are regularly arranged at a small pitch to attain a high resolution, many difficulties arise. When the wall of each aperture is tilted so as to enable the electron beam to completely pass through, the dimension of the large opening of each aperture must be made so large that large openings of the adjacent electron beam apertures can merge on the surface of the shadow mask.

In order to solve these problems, Jpn. Pat. Appln. KOKOKU Publication No. Sho 47-7670 has proposed a so-called off-center mask in which the aperture center of the large opening of the electron beam aperture in the shadow mask deviates from the aperture center of the small opening of the aperture in a direction in which the electron beam passes. This deviation method, to the extent needed, is efficient for preventing a beam omission from being caused when the incident electron beam collides against the wall surface or edge of the large opening of the aperture. It is also effective for preventing the mechanical strength of the mask from being reduced because the large opening of the aperture can be kept small.

The off-center mask, however, requires that for a certain degree of large opening aperture deviation, the small opening must be enlarged to prevent beam omission. With this configuration, when the electron beam aperture is viewed from the side of the shadow mask, its physical diameter differs from that of the beam spot formed on the phosphor screen by the electron beam which has passed through it. Furthermore, the shape of the electron beam aperture formed at a boundary between the large and small openings of the aperture is not circular but deformed, and accordingly is not stable. In the color cathode ray tube which has a small electron beam landing area on the phosphor screen, degradation in the uniformity of color purity is more likely.

In order to make the off-center amount between the large and small openings of the aperture small and to appropriately tilt the wall surface of the large opening, the dimension of the large opening must be increased to a limit, which limit depends upon the pitch of the apertures. The flattened shadow mask with a large radius of curvature with this aperture configuration has a weakened tension strength after being press-formed. As the dimension of the large opening of the aperture is increased, its mechanical strength weakens even further. This causes the shadow mask to be easily deformed.

When the thickness of the shadow mask is increased for mechanical strength, it becomes difficult to control the etching by which each electron beam aperture is formed. Quality is thus compromised. When the shadow mask is thickened, the tilt of the wall surface defining the large opening of the aperture must be increased. The off-center amount must be therefore made large, thereby causing many of the same problems.

As means for preventing beam omissions, it has been proposed that the distance from the boundary between the large and small openings of each electron beam aperture to the surface of the shadow mask which is on the electron-gun side is increased and that the tilt of the wall of the large opening of each electron beam aperture is decreased. In this scenario, however, more electron beams collide against the wall surface of the small opening of the aperture and the contrast is lowered by the electron beam reflected by the wall surface.

The inventors of the present invention propose a design and method to improve the shape of the electron beam apertures in the shadow mask in a color cathode ray tube so as to pass electron beams through the apertures without collision with the aperture edges or wall surface and to prevent weakening of the tension strength of the shadow mask.

SUMMARY OF THE INVENTION

The present invention is intended to eliminate the above-mentioned drawbacks. It provides a color cathode ray tube which has a flatter shadow mask having a larger radius of curvature but capable of more effectively preventing electron beam omissions while having a greater mechanical strength to prevent deformation. Another object is to provide a method of manufacturing the shadow mask.

In order to achieve the above objects, a color cathode ray tube comprises a face panel having a phosphor screen formed on the inner face thereof; an electron gun arranged to oppose the phosphor screen and to emit a plurality of electron beams toward the phosphor screen; and a shadow mask arranged between the face panel and the electron gun to oppose the phosphor screen and having a large number of electron beam apertures which are regularly positioned over most of the shadow mask and through which the electron beams pass. The shadow mask has a first surface opposed to the electron gun, a second surface opposed to the phosphor screen, and a mask center aligned with a tube axis of the cathode ray tube.

The first surface of the shadow mask is configured so as to define the small opening of each electron beam aperture. The second surface is configured so as to define the large opening of each electron beam aperture having a larger diameter than that of the small opening. The large opening communicates with the small opening. A wall surface of the shadow mask, which defines the shape of the aperture between the first and second surfaces, includes a bulged portion which extends in a radial direction from the center of the shadow mask.

According to the above-described color cathode ray tube, electron beams emitted from the electron gun enter into the peripheral portion of the shadow mask at a larger angle from the normal of the first surface of the shadow mask, as compared with those entering into the center portion thereof. The bulged portion is formed in the region of the second mask surface defining the large opening of each aperture. The bulge portion extends in the radial direction with respect to the mask center. Therefore, the electron beams can enter the small openings in the first surface of the shadow mask, travel through the aperture and out the large opening with its bulged portion, and strike the phosphor screen, without colliding against the wall surface or edges of the aperture. This prevents omission of electron beams.

The bulged portion must be formed at least in that portion of the large opening defining wall surface which is located outward in the radial direction. Therefore, rather than increasing the entire diameter of the large opening of the aperture, only a portion or a bulge is utilized, thus the volume of the shadow mask remains high and the corresponding mechanical strength is maintained.

According to the present invention, a method of manufacturing the shadow mask comprises the steps of: forming a resist film on a second surface of the shadow mask through a printing pattern which has a first pattern including a large number of opaque dots provided to correspond to positions where large openings are to be formed, and a second pattern including independent sub-patterns each of which is positional so as to be located outside the periphery of each dot located at a peripheral portion of the mask material, the sub-patterns corresponding to the positions of the bulge portions; exposing the formed resist film such that the dots of the first pattern and the sub-patterns of the second pattern are exposed; removing the unexposed resist film; and etching the second surface of the mask material through the exposed resist film, to form numerous the large openings and the bulged portions.

According to the above-described method, the large opening of each of the electron beam apertures is formed by etching the mask material through the first pattern of circular dots each having such a size that causes no beam omission, and the bulge is formed by etching through the second pattern of independent sub-patterns located outside each dot along which the electron beam passes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 through 4B show a color cathode ray tube according to an embodiment of the present invention, in which:

FIG. 1 is a longitudinal sectional view of the color cathode ray tube,

FIG. 2 is a front view of the color cathode ray tube,

FIG. 4B is a sectional view taken along a line IV—IV in FIG. 3B;

FIGS. 5A through 7E show a method of manufacturing the shadow mask, in which:

FIG. 5A is a plan view showing a resist film for small openings,

FIGS. 7A through 7E are sectional views respectively showing etching processes of the shadow mask described above;

FIGS. 8 and 9 show a shadow mask in the color cathode ray tube according to another embodiment of the present invention, in which:

FIG. 8 is a sectional view showing a part of the shadow mask, and

FIG. 9 is a plan view showing some of electron beam apertures in the shadow mask; and FIGS. 10 through 11B show a resist film used in a method of manufacturing the shadow mask according to an embodiment of the present invention, in which:

FIG. 10 is a plan view of a resist film for large openings,

FIG. 11B is an enlarged plan view showing a large opening pattern having a divided ring-shaped sub-pattern.

DETAILED DESCRIPTION OF THE PREFERRED EMBODIMENTS

Some embodiments of the present invention will be described in detail with reference to the accompanying drawings.

Figure 1:
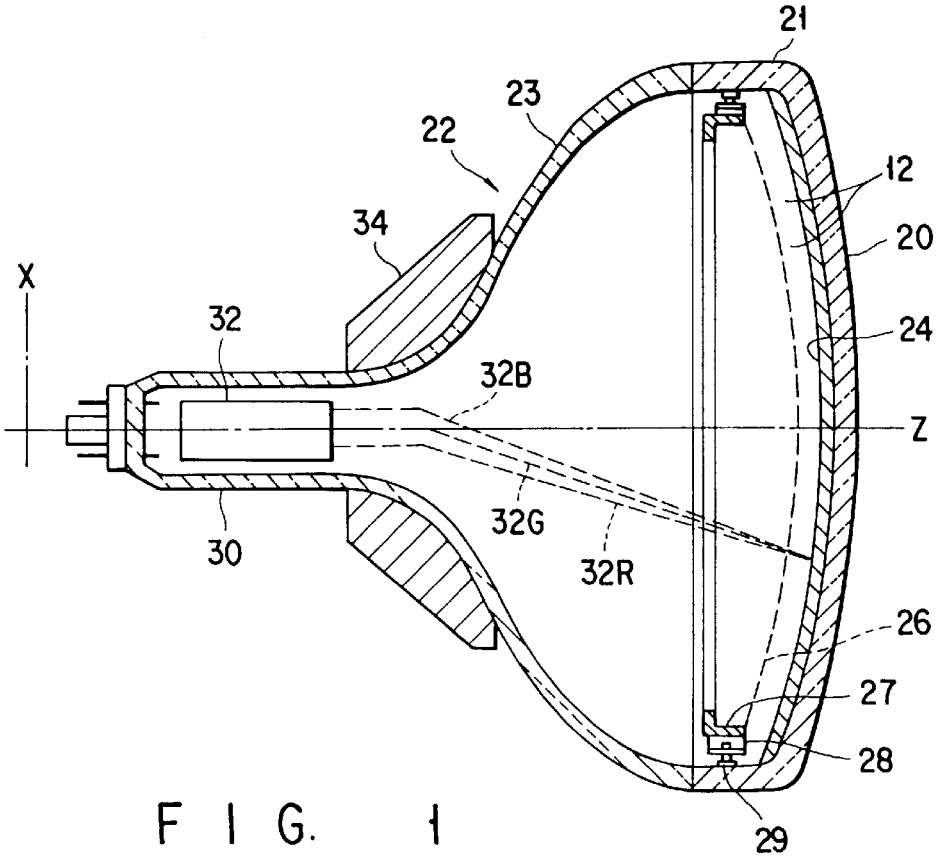

As shown in FIG. 1, the color cathode ray tube according to an embodiment of the present invention has a glass envelope 22, which companies a substantially rectangular face panel 20, a skirt portion 21 continuous wit-in the face panel 20, and a funnel 23 integrally bonded to the skirt portion 21. A phosphor screen 24, on which phosphor dots that emit light in red, blue and green are regularly arranged, is formed on the inner surface of the face panel 20. An electron gun 32 for emitting three electron beams 32R, 32B and 32G corresponding to red, blue and green is disposed in a neck 30 of the funnel 23. The detection gun is arranged on a tube axis Z of the cathode ray tube.

Figure 2:
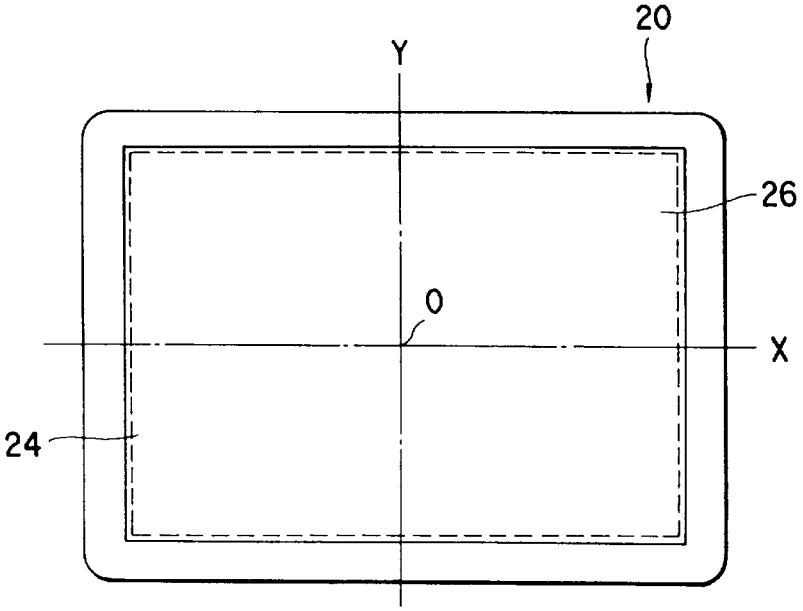

A substantially rectangular shadow mask 26 having a large number of regularly arranged electron beam apertures 12 is arranged in the envelope 22 and closely opposes the phosphor screen 24 at a predetermined distance. The peripheral edge portion of the shadow mask 26 is fixed to a mask frame 27, and a mask holder 28 provided on the mask frame 27 is fitted on stud pins 29 which are fixed to the skirt portion 21, so that the shadow mask 26 is installed inside the face panel 20. As shown in FIG. 2, the phosphor screen 24 has a rectangular shape, when viewed from the front, and has a center 0 through which the tube axis Z extends, and a vertical axis Y and a horizontal axis X both extending through the center 0. The shadow mask 26 also has a mask center through which the tube axis Z extends.

The three electron beams 32R, 32G and 32B emitted from the electron gun 32 are deflected by a magnetic field generated by a deflection yoke 34 which is mounted on the outer surface of the funnel 23. The deflected electron beams are subjected to selection by the shadow mask 26 and scan the phosphor screen 24 in the horizontal and vertical directions, thereby displaying a color image on the face panel 20.

As shown in FIGS. 3A, 3B, 4A and 4B, the shadow mask 26 is formed of a thin metal plate. The circular electron beam apertures 12 are regularly formed in the metal thin plate at a predetermined opening pitch. Each electron beam aperture 12 has a small opening 40 open to a surface 26*a* of the shadow mask 26 on the side of the electron gun 32, and a large opening 42 open to a surface 26*b* of the shadow mask 26 on the side of the phosphor screen 24 and communicating with the small opening 40. The small opening 40 is defined by a substantially arcuated recess having a circular open edge. Similarly, the large opening 42 is defined by a substantially arcuated recess having a circular open edge which has a diameter larger than that of the circular open edge of the small opening 40. The small and large openings 40 and 42 communicate with each other at the bottom portions of these recesses. A minimum-diameter portion of the electron beam aperture 12 that determines the aperture diameter of the electron beam aperture 12 is defined by the boundary 43 between the small and large openings 40 and 42.

Figure 3A:
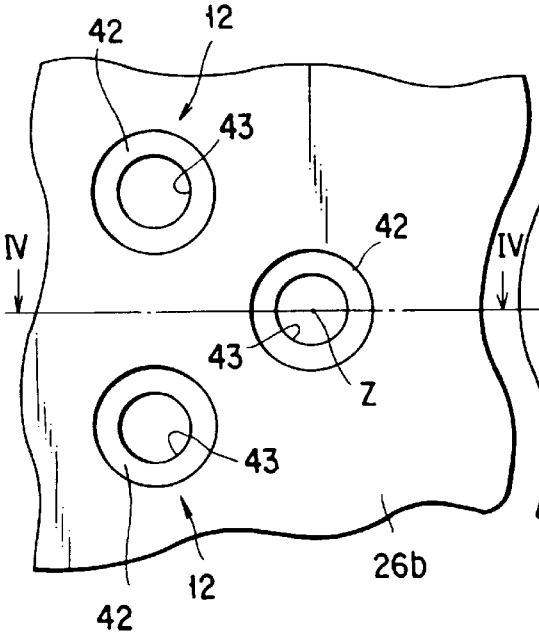
FIG. 3A is a plan view schematically showing the center portion of a shadow mask enlarged, FIG. 3B as is a plan view schematically showing the peripheral portion of the shadow mask enlarged.
Figure 4A:
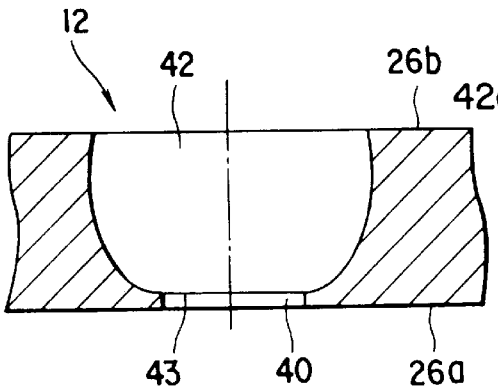
FIG. 4A is a sectional view taken along a line IV—IV in FIG. 3A.

As shown in FIGS. 3A and 4A, in the central portion of the shadow mask 26, which includes the tube axis Z, the small and large openings 40 and 42 of each electron beam aperture 12 have a coaxial relationship, since electron beams emitted from the electron gun 32 are perpendicularly incident on the surface 26*a* of the shadow mask 26.

Figure 3B:
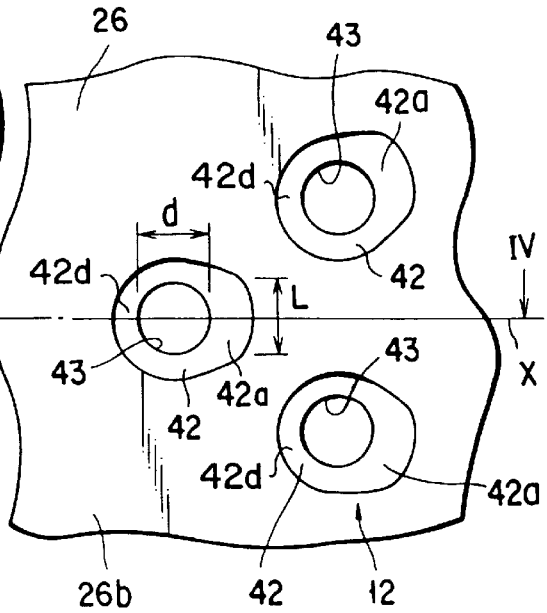
Figure 4B:
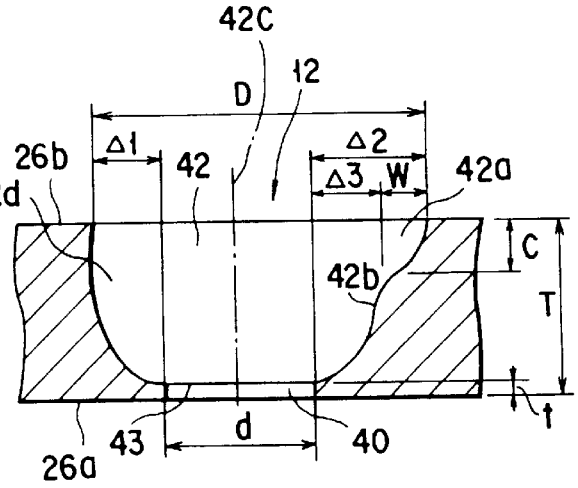

As shown in FIGS. 3B and 4B, in the peripheral portion of the shadow mask 26, the small and large openings 40 and 42 of each electron beam aperture 12 are also formed coaxially. In the peripheral portion of the shadow mask 26, however, the electron beam are obliquely incident on the surface 26*a* of the shadow mask 26 and the electron beam apertures 12. In the peripheral portion of the shadow mask 26, therefore, the large opening 42 of each electron beam aperture 12 has an open shape which is not entirely circular. A bulge portion of the large opening 42*a* extends the periphery of the large opening 42 radially with respect to the mask center.

More specifically, the wall surface of the shadow mask 26 which defines the large opening 42 includes a bulged portion 42*a* which is bulged outward (see the right side of a center axis 42*c* of the large opening 42 in FIG. 4B) in a radial direction from the center of the shadow mask 26. A width L of the bulged portion 42*a* in a direction of a tangential line relative to the open edge of the large opening 42, that is, a width in a direction perpendicular to the radial direction about the mask center, is made substantially equal to or slightly larger than a diameter of the electron beam aperture 12 or diameter d of its minimum-diameter portion 43. Further, the bulged portion 42*a* is formed in the wall surface of the shadow mask 26 which defines the large opening 42 of each electron beam aperture 12, extending from a shifting point 42*b*, which is located in the substantially middle of the wall surface in the axial direction of the large opening 42, to the open edge of the large opening 42.

A distance W of the bulged portion 42*a* extends from the shifting point 42*b* to the open edge of the large opening 42 in the radial direction thereof, that is, W defines the extent to which the portion 42*a* is bulged. This distance W increases for those electron beam apertures 12 which are arranged increasingly nearer to the peripheral portion of is the shadow mask 26 where the angle of the electron beam incident on them is larger. Similarly, a distance C extending from the shifting point 42*b* to the open edge of the large opening 42 in the axial direction thereof increases for the electron beam apertures 12 located nearer to the outer edge of the shadow mask 26.

A region 42*d* of the large opening 42 for apertures located near the peripheral of the shadow mask 26 is located on the mask center side of the large opening with respect to the center axis 42*c*, or opposite the bulged portion, and has a distance between the open edge of the minimum diameter portion 43 and that of the large opening 42 in the radial or horizontal direction denoted by Δ1. Further, in bulge portion region 42*a* of the large opening 42, assume that the distance between the open edge of the minimum diameter portion 43 and that of the large opening 42 in the radial or horizontal direction is denoted by Δ2 which is equal to (Δ3+W). Then, Δ1 and Δ2 represent inclination of these regions of the large opening 42. A dimension D of the large opening 42 at the open edge thereof is denoted by (Δ1+Δ2+d). That portion of the large opening 42 which is represented by the distance (D−W) is a substantially circular opening and its center is located coaxial with that of the minimum-diameter portion 43. When the large opening defining wall surface along which the electron beam passes has a distance Δ2 which is small, a bulge is formed 42*a* so as to make Δ2 to the desired value.

In one embodiment of the invention, when the opening pitch of the electron beam apertures 12 is 0.27 mm and the shadow mask used in a 14-inch color CRT has a large radius of curvature, thickness T of the shadow mask 26 is set to 0.13 mm, large opening diameter D is 0.205 mm, diameter d of the minimum-diameter portion 43 is 0.125 mm, height t from the surface 26*a* of the shadow mask 26 to the minimum-diameter portion 43 is 0.02 mm, bulged extension W is 0.035 mm, height c from the surface 26*b* of the shadow mask 26 to the shifting point 42*b* of the bulged portion is 0.03 mm and width L of the bulged portion 42*a* is 0.13 mm.

According to the above-described shadow mask 26, each of the electron beam apertures 12, which are located at the peripheral portion of the shadow mask 26 where the incident angle of the electron beam entering into shadow mask 26 is large, has the bulged portion 42*a* which is located in the radially outward portion of the large opening 42, i.e., defined in that portion of the large opening 42 along which the electron beam passes and which is located on the outer periphery of the large opening 42 in the radial direction with respect to the mask center of the shadow mask. Accordingly, the electron beams emitted from the electron gun 32 and entering into each of the electron beam apertures 12 can pass through the minimum-diameter portion 43 and then reach the phosphor screen 24, without being shielded or impeded by the wall surface of the large opening 42 and the open edge thereof. The election bean can then form an electron beam spot having a predetermined shape on the phosphor screen 24.

Further, the large and small openings 42 and 40 of each of the electron beam apertures 12 are coaxial in relation to each other. That is, they share the same central axis 42*c*. Therefore, the shape of the minimum-diameter portion 43 at which the large and small openings 42 and 40 communicate with each other can be kept substantially circular and need not be deformed. As a result, an electron beam spot having a desired shape can be formed on the phosphor screen 24.

Furthermore, the formation of the bulged portions 42*a* makes it possible to prevent electron beam omissions without unnecessarily enlarging the large opening 42. The amount of the shadow mask 26 etched from the side of the large opening 42 can be made smaller, thereby preventing unwanted reduction of the volume of the shadow mask 26. As compared with the conventional shadow masks, therefore, the mechanical strength of the shadow mask 26 is maintained, thereby preventing the tension strength of the mask from being weakened after being press-formed.

As the result, in the color cathode ray tube containing shadow masks which are higher in definition, flatter and have a larger radius of curvature, uniform brightness is achieved at both the central and peripheral portions of the phosphor screen. The image thus displayed has excellent uniformity and color purity. In addition, the mask tension strength of the mask is higher after it is press-formed. This prevents the shadow mask from being deformed by jostling or movement during manufacturing and transporting and after it is incorporated into a television set or display unit.

A method of manufacturing the above-described shadow mask will next be described. First, a printing pattern used for forming the shadow mask is explained.

In a printing pattern, a large number of dot arrays each including a circular dot pattern are arranged in accordance with the aperture shape of the shadow mask 26 to be formed. Separate printing patterns are necessary for the large and small openings, and the designs of the printing patterns are different between the large and small openings.

Figure 5A:
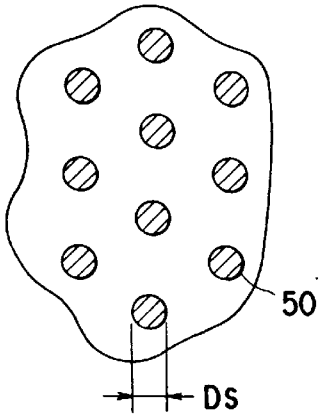

As shown in FIG. 5A, a small opening pattern is formed of opaque dot patterns 50, and the diameter Ds of the respective dots are substantially the same throughout the surface of the shadow mask. However, if shadow masks have different grades due to etching although the mask aperture diameters of the shadow mask specifications formed by etching are uniform, or if the shadow mask specifications specify masks having different grades, the dot diameter Ds of the-small opening pattern must be appropriately changed in accordance with the location on the shadow mask.

Figure 5B:
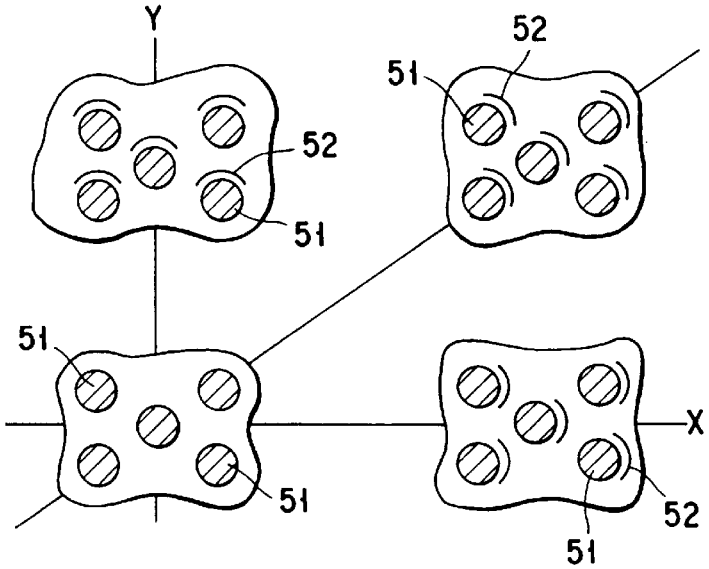
FIG. 5B is a plan view showing a resist film for large openings.

FIG. 5B schematically shows the large opening pattern located at the central portion and the respective axial end portions of the shadow mask in the first quadrant of FIG. 2. In the central portion, the large opening pattern has a large number of opaque circular dot patterns 51 having a diameter larger than that of the small opening circular dot patterns 50. In the peripheral portion, the large opening pattern has a first pattern defined by a large number of the circular dot patterns 51, and a second pattern defined by a large number of arcuated independent patterns (sub-patterns) 52 for forming bulged portions on the side of the dot patterns 51, from which the electron beam propagates.

The center of each dot of the large opening circular dot pattern 51 substantially corresponds to the center of each dot of the small opening dot pattern 50. In a region extending from the mask center of the shadow mask to an arbitrary position, since the electron beam incident angle to the aperture 12 is small and the value of Δ2 necessary for not causing eclipse of the beam at the open edge of the large opening is small, the large openings are formed only of the opaque circular dot patterns having the same shape as that of the small openings.

The large opening pattern used for the peripheral portion of the shadow mask along the horizontal axis will be described with reference to FIGS. 6A through 6D.

When a dot diameter of the large opening dot pattern 51 is changed, even if a pattern dot diameter Ds of the small openings is constant, the electron beam aperture size D (refer to FIG. 4B ) obtained by etching, also changes. Accordingly, the dot diameter Dn of the large opening pattern is basically uniform throughout the shadow mask.

Figure 6A:
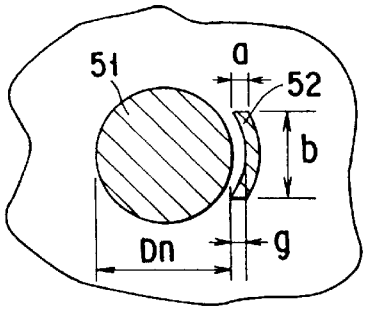
FIG. 6A is an enlarged plan view showing a large opening pattern having an arcuated sub-pattern.
Figure 6C:
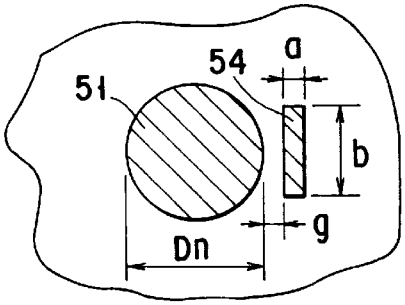
FIG. 6C is an enlarged plan view showing a large opening patter having a linear sub-pattern.
Figure 6B:
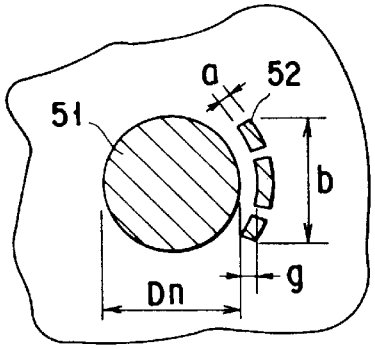
FIG. 6B is an enlarged plan view showing a large opening pattern having a divided arcuated sub-pattern.

As shown in FIG. 6A, the arcuated patterns 52 which are arranged independently of the large opening dot patterns 51 are formed a certain distance beyond the periphery of the respective dot patterns and 51 on the side of the dot patterns which is farthest away from the center of the shadow mask. A width a of the arcuated pattern 52 in the radial direction, a length b of the arcuated pattern 52 in the circumferential direction, and a gap g between the arcuated pattern 52 and the dot pattern 51, are set to be constant throughout some regions in the shadow mask. In other regions, these dimension are gradually changed depending on their position in the shadow mask. The length b of the arcuated pattern 52 in the circumferential direction is long enough to enable the electron beam to completely pass through the shadow mask to the phosphor screen. The arcuated pattern 52 length b is designed to be equal to or slightly longer than the diameter d of the small opening. A second pattern is not limited to an arcuated pattern, but can be a linear pattern 54, as shown in FIG. 6C.

Figure 6D:
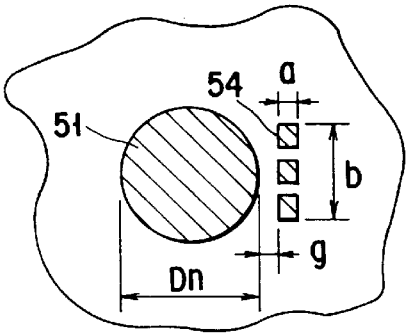
FIG. 6D is an enlarged plan view showing a large opening pattern having a divided linear sub-pattern.

In the etching process, the hatched portions in FIG. 6A are etched, and the resist film present between the dot pattern 51 and the arcuated pattern 52 tends to float. Depending on the types of the masks, the resist film at this position can be easily separated from the mask material by the impact of the sprayed etchant, and the separated resist film in the etchant can clog the spray nozzle. To address this problem, the arcuated pattern 52 may comprise a divided arcuated pattern as shown in FIG. 6D, or the linear pattern 54 may comprise a divided linear pattern, both of which are separated by appropriate gaps. The gap of separation of the divided arcuated or linear pattern is chosen so as to not disrupt formation of the desired bulged portion. It is preferable that the gap is selected in a range of 10–30 μm.

If the gap g between the dot pattern 51 and the arcuated pattern 52 (or linear pattern 54) is too small, as side etching progresses, the gap g can be joined to the large opening dot portion within a short period of time. Then, an appropriate bulged portion is not formed and the aperture may be deformed. If the gap g is excessively large, the arcuated pattern 52 is not easily joined to the large opening dot pattern, and an aperture formed with the desired bulged portion cannot be obtained. Therefore, consideration must be given regarding the timing of the joining of the large opening dot pattern and the arcuated pattern during etching and the resulting shape of the walls of the aperture after the patterns are joined.

As the width a of the arcuated pattern 52 or linear pattern 54 increases, the amount of side etching increases, resulting in a deeper hole. More specifically, if the width a is too large, the electron beam aperture can be easily deformed resulting in an undesirable bulged portion.

The mechanical strength of the shadow mask can be increased by suppressing the etching amount of the bulged portion. To decrease the amount of material etched away from the shadow mask, it is preferable that the width a of the arcuated pattern 52 or linear pattern 54 is small. However, the width actually printed on the resist film depends on the coarseness of the surface of the mask material, the resolution of the resist film, and the thickness of the resist film. Therefore, when casein and bichromate ammonium are used as the resist material, the width a is preferably selected in range of 10 to 30 μm.

Formation of the mask printing pattern described above is performed by using a photoplotter with automatic drawing. First, a high-resolution glass photographic plate is fixed on the plotter by suction with its emulsion surface facing upward. Pattern drawing data recorded as magnetic recording data is transmitted to the plotter through a computer, and light is radiated on the emulsion surface by the plotter in accordance with data, thereby forming a pattern latent image.

After drawing, the steps of development, washing with water, stopping, fixing, further washing with water, and drying are sequentially performed to form the desired mask printing pattern. In practice, a working pattern used in the shadow mask manufacturing process is not the pattern itself which is drawn by the photoplotter. The drawn pattern is reversed and brought into tight contact with a glass photographic plate to form a reverse image. Any defects of this reverse image are corrected, thereby forming a master pattern. A pattern formed by reversing the master pattern again and bringing it into tight contact with a glass photographic plate is used as the working pattern. When the master pattern is prepared, numerous working patterns can be easily formed by reversing and bringing the master pattern into tight contact with a glass photographic plate a number of times to form the desired number of working patterns. The arcuated pattern for the large openings may be formed by using drawing means that forms an arc in accordance with linear interpolation.

As an example of desirable dimensions for a printing pattern for manufacturing a shadow mask in a 14-inch color cathode ray tube having a large radius of curvature: thickness T is 0.13 mm; an electron beam aperture pitch is 0.27 mm; the small opening dot pattern diameter Ds is 0.09 mm; the large opening dot pattern diameter Dn is 0.105 mm; the gap g between the dot pattern and the arcuated pattern is 0.02 mm; the width a of the arcuated pattern in the radial direction is 0.02 mm; and the length b of the arcuated pattern in the circumferential direction 0.075 mm.

A method of manufacturing the shadow mask by using the above-mentioned pattern will be described.

A shadow mask material having a predetermined thickness is decreased and cleaned by alkali solution. Both surface are then coated with a photo-resist film having a predetermined thickness, and dried. Printing patterns prepared as described above to form the small and large openings are brought into tight contact with the resist films coated on both surfaces of the mask material, and latent images of the patterns are formed in the resist films using ultraviolet rays.

Hot water of about 40° C. is sprayed on each resist film on which the predetermined pattern is formed in the above manner, thereby dissolving and removing the non-exposed portion of the resist film. Thus, those portions of the mask material on which electron beam apertures are to be formed are exposed outside. After developing the resist films, each of the resist films is annealed at a temperature of-about 200° C. in order to increase its etching resistance.

The next step in the process is the etching. If the mask material contains iron as the major component, a high temperature solution of ferric chloride is sprayed to the mask. For a high resolution shadow mask having small electron beam aperture pitch and size, etching is performed in two-step manner. Various kinds of two-step etching have been proposed and an example of them is described below.

Figure 7A:
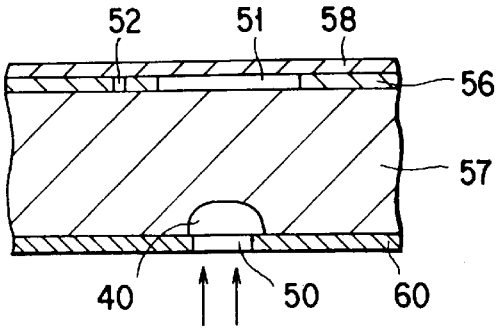

As shown in FIG. 7A, a protection film 58 is bonded to a resist film 56 formed on the large opening side surface of a mask material 57. Etching solution is then sprayed to the small opening side surface of the mask material through the circular dot pattern 50 of a resist film 60 formed on the small opening side surface, and this etching is performed until the small opening 40 having a desired size is formed. In this state, the large opening side of the mask material is covered with the protection film 58 so that it will not be etched. The mask material 57 is then washed by water and the resist film 60 and the protection film 58 are peeled off from the small and large opening sides of the mask material. The mask material 57 is again washed by water and dried.

Figure 7B:
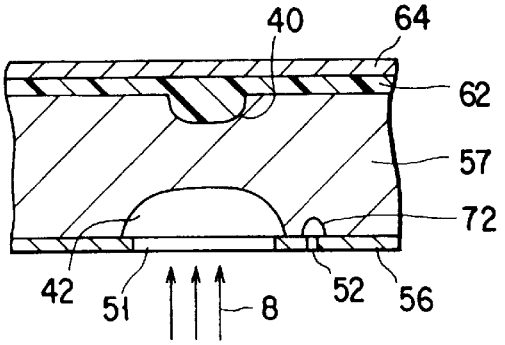

As shown in FIG. 7B, varnish which serves as an anti-etching material 62 is applied to the small opening side surface of the mask material 57 while filling the small opening 40 formed in the surface by etching, and a protection film 64 is then bonded to it. In this state, the small opening side surface of the mask material 57 is protected by the anti-etching material 62 and the protection film 64. No etching, therefore, progresses in the small opening side surface.

Figure 7C:
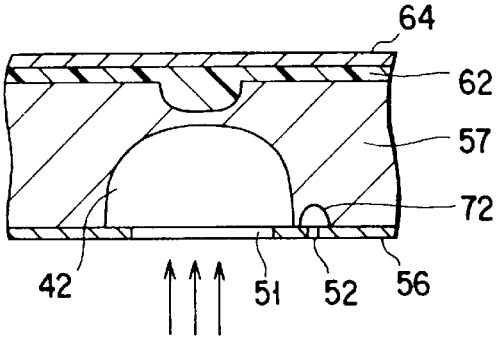

A second step of the etching process is then applied to the large opening side surface of the mask material 57. At this step, the etching solution or etchant is sprayed to the large opening side surface of the mask material 57 through the circular dot patterns 51 patterned in the resist film 56 on the large opening side and also through the arcuated patterns 52 patterned in adjacent to the respective patterns 51. Etching of the large opening 42 and a bulged portion forming area 72 thus advances, corresponding to the circular dot pattern 51 and the arcuated pattern 52, respectively. The etching advances in the depthwise and lateral (side etching) directions without joining the large opening 42 and the bulged portion forming area 72 to each other, as shown in FIG. 7C.

Figure 7D:
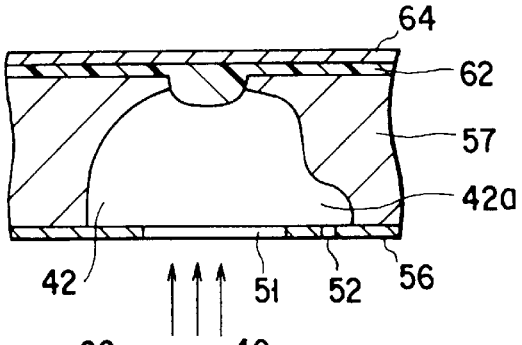

When the etching further progresses, the large opening 42 and the bulged portion forming area 72 join each other by advancing side etching, as shown in FIG. 7D. By this joining, the bulged portion 42*a* is formed, having the shifting point 42*b* on the large opening wall surface of the mask material 57. The small and large openings 40 and 42 are also joined to each other by etching advancing in the depthwise direction. When the large opening 42 arrives at an intended size or sectional shape, the etching is finished.

Figure 7E:
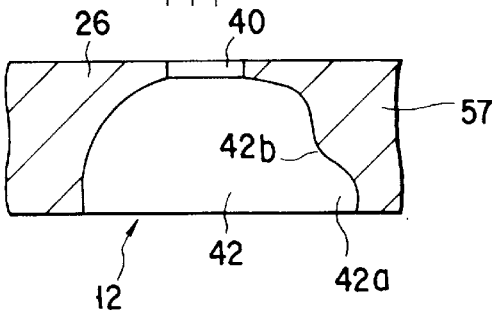

The anti-etching material 62 and the protection film 64 are then removed from the small opening side surface of the mask material 57 while removing the resist film 56 from the large opening side surface thereof. The shadow mask 26 provided with intended electron beam apertures 12 is thus manufactured, as shown in FIG. 7E, and the second etching step is now completed.

When executing the second etching step, a smaller width a of the arcuated pattern 52 in the radial direction, causes slower etching in the lateral and depthwise directions. In addition, a larger gap g between the large opening dot pattern and the arcuated pattern, slows the joining of the large opening and its corresponding arcuated pattern area. As the result, the bulged portion 42*a* has a larger width but a smaller depth.

A larger height c extending from the open edge of the large opening 42 to the shifting point 42*b* of the bulged portion 42*a*, causes more volume of the shadow mask to be etched away. It is therefore desirable that the height c is made smaller than ⅓ of the mask material thickness T. The shape of the bulged portion 42*a* provided with the shifting point 42*b* depends upon the pattern design and it is also influenced by etching conditions such as temperature and density of etchant and spraying pressure. It is desirable that final mask pattern design is confirmed by results obtained from the practical shadow mask manufacturing process.

According to the above-described shadow mask manufacturing method, the size of the small opening that substantially determines the size of the electron beam aperture is determined and fixed in the first step etching. The aperture size varies less in the method of the present invention when compared with a scheme wherein the mask material is etched from the both surfaces and an etchant is blown through the communicating portion after the large and small openings communicate with each other as well. Thus, the method of this embodiment is suitable for the manufacture of a high definition shadow mask.

Figure 8:
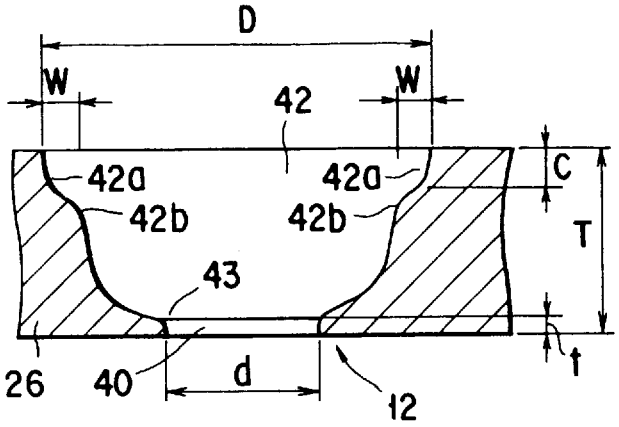
Figure 9:
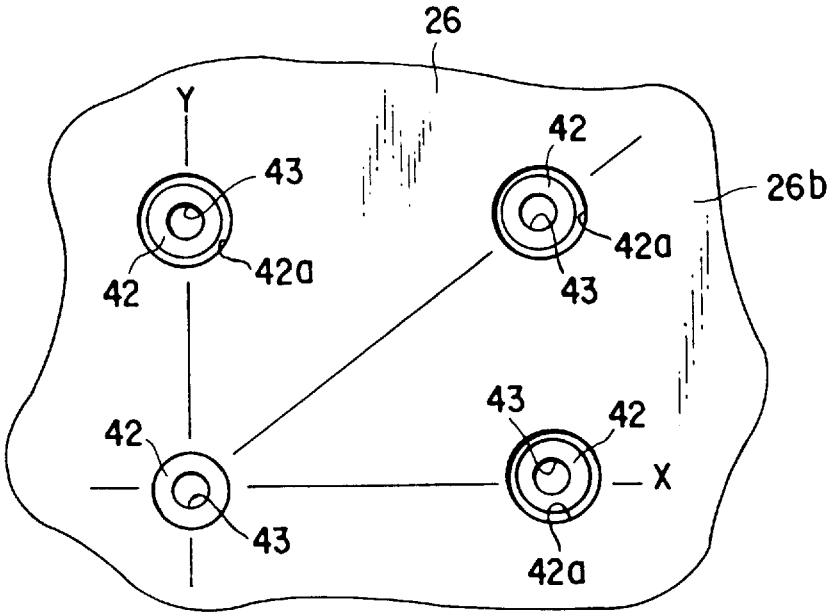

Although the bulged portion 42*a* has been formed only on a portion (radially outward portion) of the large opening a ring-shaped or annular bulged portion 42*a* may be formed along the entire open edge of the large opening 42, as shown in FIGS. 8 and 9. Specifically, that portion of the wall surface of the shadow mask 26, defining the large opening 42 of each of the electron beam apertures 12 at the peripheral portion of the shadow mask, which is adjacent to the open edge of the large opening and extends along the entire open edge, is bulged radially outward from its center axis to thereby defining an annular bulged portion 42*a*. Each of the electron beam apertures 12 thus formed is symmetrical with respect to its center axis.

The shadow mask 26 having those electron beam apertures 12 which are formed as described above can prevent omissions of electron beams passing through the electron beam apertures, as seen in the above-described embodiment. Further, only that portion of the wall surface which is adjacent to the open edge of the large opening is made larger in diameter. As compared with a case where the entire wall surface which defines the large opening is made larger in diameter, the volume of the shadow mask 26 can remain high and its mechanical strength can be increased accordingly.

Figure 10:
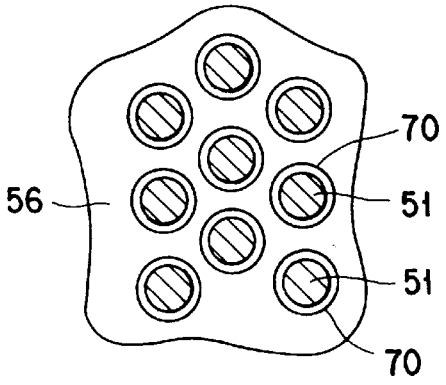
Figure 11A:
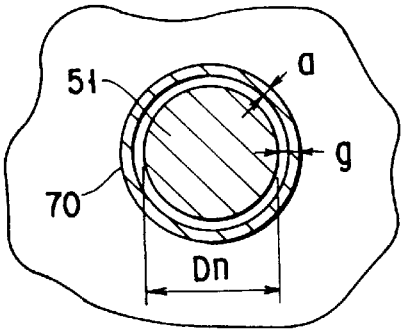
FIG. 11A is an enlarged plan view showing a large opening pattern having a ring-shaped sub-pattern.

When the large opening having the above arrangement is formed by etching, each large opening pattern formed in the resist film 56 has a first pattern constituted by a large number of circular dot patterns 51 and a second pattern constituted by a large number of annular patterns 70 formed around the respective circular dot patterns 51 to be coaxial with them, as shown in FIGS. 10 and 11A. The width a of the annular pattern 70 and the gap g between the annular pattern 70 and the circular dot pattern 51 are set as described above. When a resist film having this arrangement and the etching scheme described above are used, an electron beam aperture 12 shown in FIG. 8 is formed.

Figure 11B:
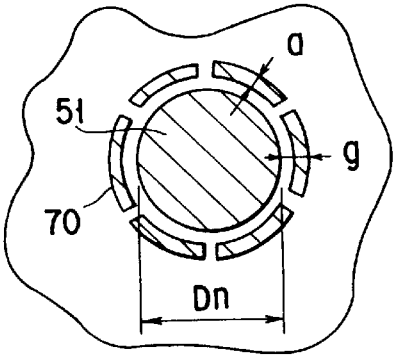

The annular pattern 70 may be divided into a predetermined number of smaller sub-patterns, as shown in FIG. 11B.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a shadow mask having a large number of electron beam apertures, each of the electron beam apertures having a small opening in a first surface of the shadow mask and a large opening in a second surface of the shadow mask, wherein said large opening has an open area larger than that of the small opening, said method comprising the steps of:

exposing a resist film formed on the second surface of a mask material through a printing pattern, the printing pattern having a first pattern including a large number of opaque dot patterns provided to correspond to positions where large openings are to be formed, and a second pattern including an independent opaque sub-pattern provided with a gap separating the second pattern and the dot patterns which are located at a peripheral portion of the mask material;

removing an unexposed portion from the exposed resist film; and etching the second surface of the mask material through the resist film, from which the unexposed portion has been removed, to form numerous large openings corresponding to the first pattern and bulged portions corresponding to the second pattern, wherein, during etching, each large opening joins with its corresponding bulged portion to form a desired aperture size and shape.

2. A manufacturing method according to claim 1, which further comprises the steps of:

exposing a second resist film formed on the first surface of the mask material through a first surface printing pattern, the first surface printing pattern including a large number of opaque small-opening dot patterns provided to correspond to positions where small openings are to be formed;

removing an unexposed portion from the exposed second resist film;

etching the first surface of the mask material through the second resist film, from which the unexposed portion has been removed, to form a large number of small openings corresponding to the small-hole dot patterns; and filling an anti-etching material in the etched small openings and coating the anti-etching material on the first surface;

the second surface of the mask material being etched after performing said filling.

3. A manufacturing method according to claim 1, wherein each of the dot patterns of the first pattern is shaped like a circle and each of the sub-patterns is shaped like an arc extending around the dot pattern.

4. A manufacturing method according to claim 3, wherein each of the arcuated sub-patterns is divided into a plurality of smaller sub-patterns.

5. A manufacturing method according to claim 1, wherein each of the dot patterns of the first pattern is shaped like a circle and each of the sub-patterns is generally linear.

6. A manufacturing method according to claim 5, wherein each of the linear sub-patterns is divided into a plurality of smaller sub-patterns.

7. A manufacturing method according to claim 1, wherein each of the dot patterns of the first pattern is shaped like a circle and each of the sub-patterns is shaped like a ring and positioned coaxially around the dot pattern.

* * * * *